United States Patent [19]

Bulso, Jr. et al.

[11] 4,454,743

[45] Jun. 19, 1984

[54] INTEGRATED CONTAINER MANUFACTURING SYSTEM AND METHOD

[75] Inventors: Joseph D. Bulso, Jr., Canton; Stephen D. Doyle, North Canton, both of Ohio

[73] Assignee: Redicon Corporation, Canton, Ohio

[21] Appl. No.: 345,194

[22] Filed: Feb. 2, 1982

[51] Int. Cl.[3] ..... B21D 22/00

[52] U.S. Cl. ..... 72/349; 72/361; 72/405; 413/69; 198/601

[58] Field of Search ..... 72/347, 348, 349, 361, 72/405, 422, 426, 3, 4, 34; 413/1, 69; 198/601, 339, 570

[56] References Cited

U.S. PATENT DOCUMENTS

| | | | |
|---|---|---|---|
| 2,753,986 | 7/1956 | Morse | 72/349 |
| 3,800,583 | 4/1974 | Miller | 72/405 |
| 3,902,347 | 9/1975 | Ridgway et al. | 72/336 |
| 3,980,297 | 9/1976 | Bulso, Jr. et al. | 271/269 |
| 4,022,089 | 5/1977 | Bulso, Jr. et al. | 83/124 |
| 4,026,226 | 5/1977 | Hahn et al. | 72/405 |
| 4,316,372 | 2/1982 | Veil | 72/4 |
| 4,373,370 | 2/1983 | Allen et al. | 72/405 |

FOREIGN PATENT DOCUMENTS 1592156 7/1981 United Kingdom .

*Primary Examiner*—Daniel C. Crane
*Assistant Examiner*—David B. Jones
*Attorney, Agent, or Firm*—Reese Taylor

[57] ABSTRACT

An integrated system and apparatus for completely forming the body of a two-piece can in one press, including performing the operations of cupping, drawing, redrawing, bottom profiling, and trimming. The system includes the concept of performing all of the operations required to form the body of a two-piece can in one press and includes feeding the precoated stock material, either in the form of sheet or coil, through a lubricator and into a feeding apparatus which, in turn, selectively feeds sufficient quantities of the stock material into a press. The press carries the double die necessary to perform the typical blanking and cupping operation and passes the cups out of the press in two lanes onto cup conveyors which feed them back into the press whereupon the draw-redraw dies on both sides of the cup die perform the additional steps of first redraw, second redraw, bottom profile, and trimming. The formed containers are then conveyed to secondary processing stations such as beaders, testers, or palletizers. In this fashion, a complete can body can be formed cheaply and economically without the normal expense of conventional forming mechanism.

8 Claims, 4 Drawing Figures

INTEGRATED CONTAINER MANUFACTURING SYSTEM AND METHOD

FIELD OF THE INVENTION

This invention relates, in general, to the forming of twopiece can bodies and relates, in particular, to an integrated system and apparatus for forming such can bodies in a single press by passing the unworked material into the press for certain forming operations and then out of and back into the same press for still further forming operations.

DESCRIPTION OF THE PRIOR ART

Two-piece cans have achieved considerable acceptance in the food and beverage field. There are a number of different methods and apparatus for forming the cylindrical body which makes up one of the two pieces of the two-piece can. These various methods include drawing and ironing and drawing and redrawing.

Most of the existing systems known to Applicant involve the utilization of a series of presses which have different tooling or die sets to perform the various operations required. Other systems include presses with body makers which iron the cylindrical body.

For example, in a draw-redraw system and starting with flat, precoated stock either in sheets or in a roll or coil form, it is necessary to perform a number of operations.

These operations include blanking or cutting out the basic work piece; cupping or initially forming the material; drawing the material; redrawing the material at least once; and trimming it. The existing art requires numerous dedicated machines that preform these operations individually.

Thus, the conventional apparatus and systems employ a series of machines, each having a different tooling to perform the various functions just enumerated.

While these prior art systems are, of course, satisfactory for the purposes for which they are designed, they are expensive for at least three reasons. For one thing, a plurality of expensive machines, each having different tooling, is required. Second, considerable floor space is required to accommodate the machines which are usually very substantial in size and weight. Third, there are sigificant energy expenses involved in operating these machines. Also, due to the number of machines involved, tooling changes, both in cost and change over time, are considerable.

SUMMARY OF THE INVENTION

It has been discovered, therefore, that a less expensive and less space consuming system can be provided to permit manufacturers to enter the two-piece can manufacturing market using a minimum amount of floor space, energy, and personnel while still effectively forming the metal from its initial state to the finished can body.

The essence of this integrated system is the utilization of a single press to perform the operations which would normally be performed with two or more machines, and this is essentially accomplished by passing the material into the press for certain operations; passing it out of the press and onto conveyors; and then back into the same press for the performance of additional operations. This is in contrast to the conventional multiple machine arrangement.

The system includes a single press which carries a double cup die capable of performing the blanking and cupping operation. Dual lane conveyors are associated with the press to receive the cups thus formed and return them to the press.

The press is also provided with draw-redraw dies arranged on opposed sides of the cup die so that the draw-redraw operations can be performed on the cups when they are returned to the press by the conveyors.

The cups are mechanically transferred from one draw-redraw station to another within the same press and are sensed at sensing stations so that material control is insured after each operation.

In this way, a complete can "line" can be provided in one press with substantial savings of capital investment, space, and energy.

Accordingly, production of an improved, integrated container body forming system becomes the principal object of this invention, with other objects thereof becoming more apparent upon a reading of the following brief specification considered and interpreted in view of the accompanying drawings.

OF THE DRAWINGS

BRIEF DESCRIPTION OF THE PREFERRED EMBODIMENT

Figure 1:
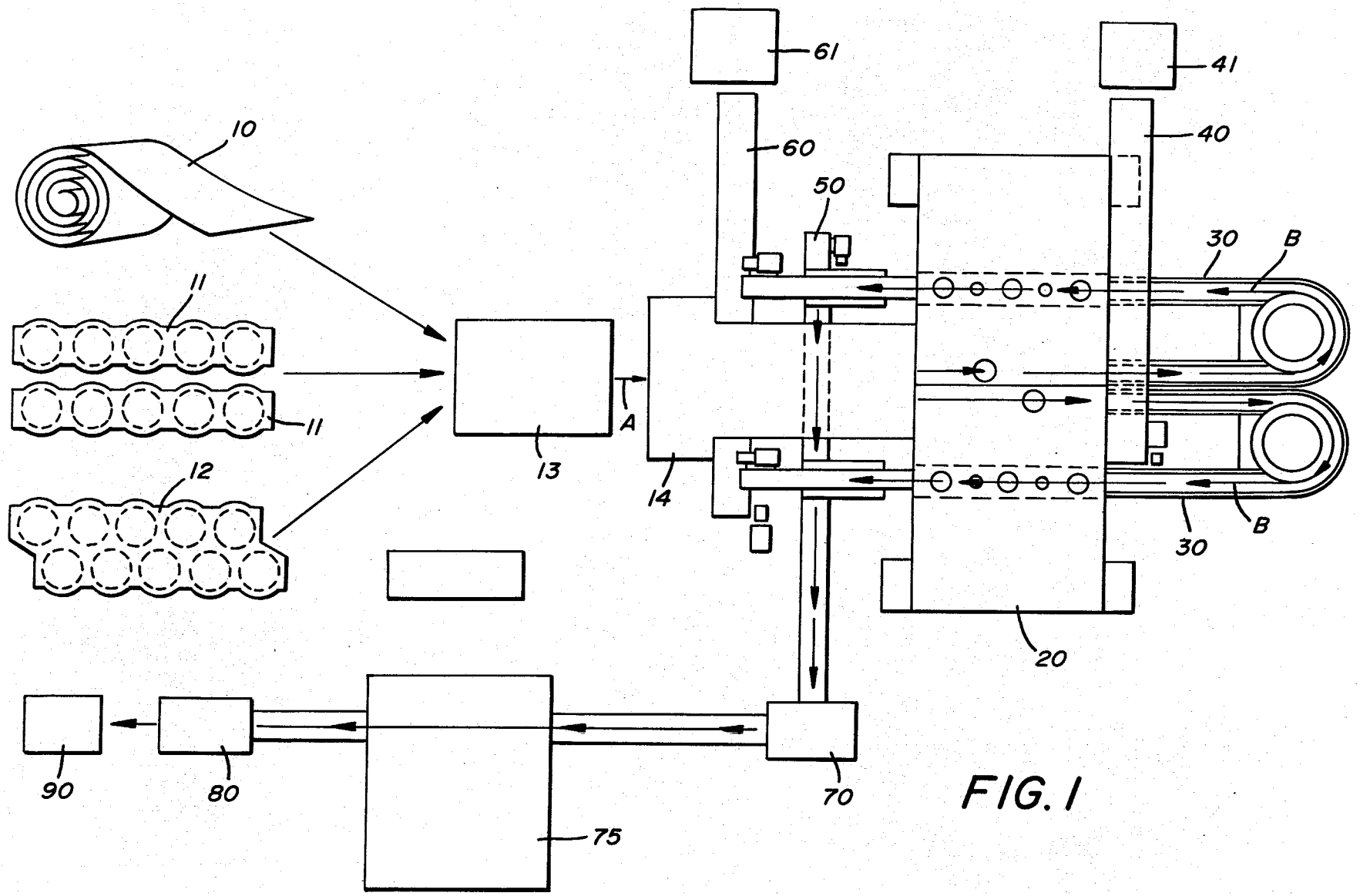
FIG. 1 is a schematic view of the system.

Referring first then to FIG. 1, it will be noted that the present system is capable of operation starting with precoated steel, aluminum, or other metal in the form of either a coil 10, two single out blanks 11, or a double out blank 12. It should be understood that the sytem is equally effective no matter what the basic source of the material and that any one of the sources 10, 11, or 12 could be employed. Therefore, while all three are illustrated in FIG. 1 of the drawings, only one would, of course, be employed in any given system at any given time.

Still referring to FIG. 1, the material may then be fed into a lubricator 13 by know means and from the lubricator 13 into a sheet or coil feed mechanism 14. The lubricator and the sheet or coil feed mechanism have only been illustrated schematically since there are a number of such devices on the market and are well known to one with ordinary skill in this art. Thus, for example, a sheet feeding mechanism can be seen in Bulso et al U.S. Pat. No. 3,980,297.

The raw material, or steel or aluminum, is then passed from the sheet or coil feed mechanism 14 into the press 20, which may be a double acting press of the character generally shown in Ridgeway U.S. Pat. No. 3,902,347. It should be noted, however, that the present invention is not intended to be limited to any particular press design and, in fact, a single action press could also be employed.

Figure 2:
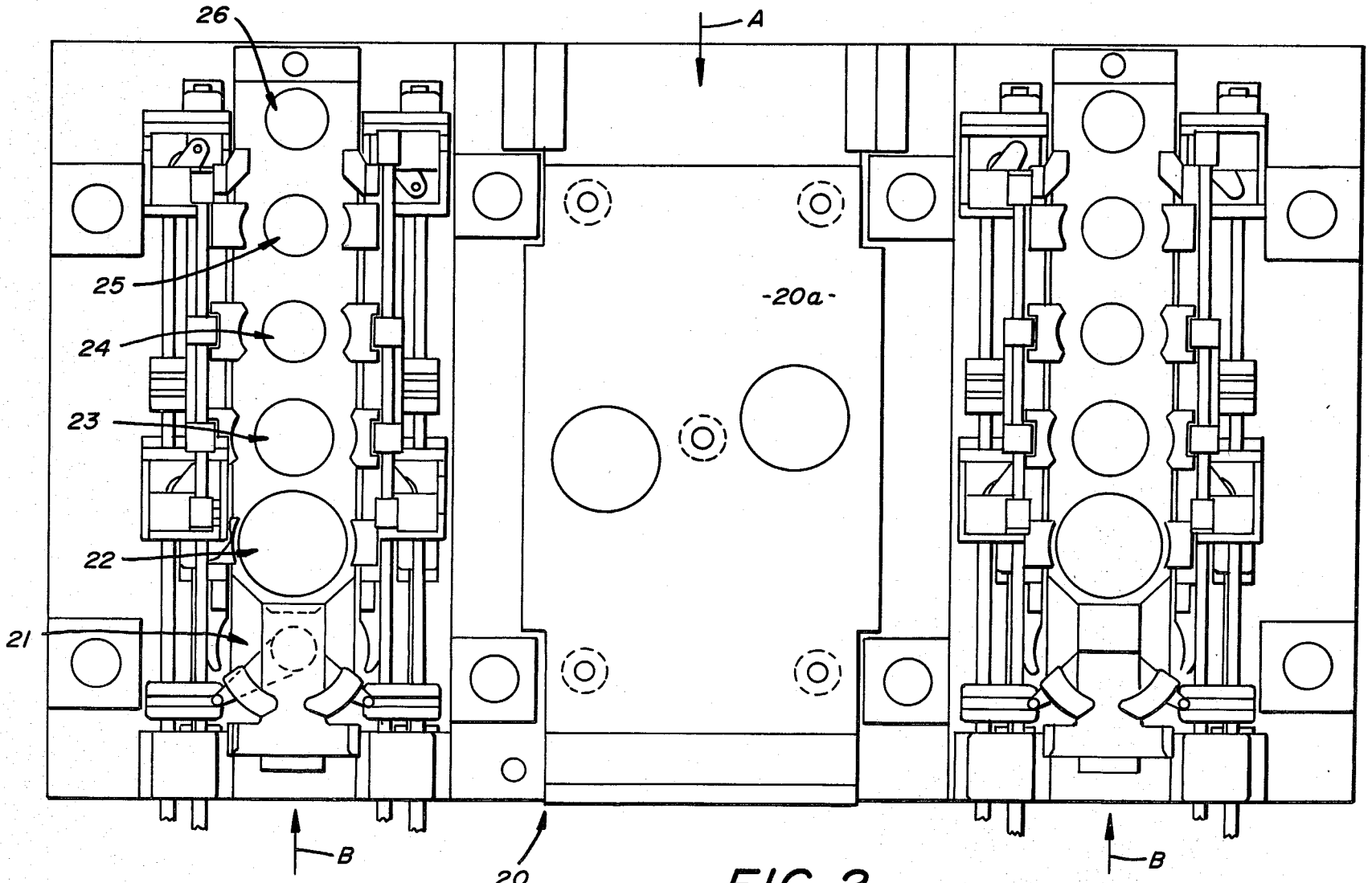
FIG. 2 is a plan view of the lower half of the die set in the press of the system.

Referring to FIG. 2 of the drawings for a more detailed description of one of the die sets which are carried in the press, it will be noted that the material is fed from left to right to FIG. 1, or in the direction of the arrow A of FIG. 2 into the die set 20*a*, which is a double blanking and cupping die and wherein the blanking and cupping operation takes place upon closure of the press 20. It will be noted that two parallel redraw dies are employed so that on any given cycle of the press two cups will be formed, and two cups C will be redrawn maintaining an equal distribution of press load.

Figure 3:
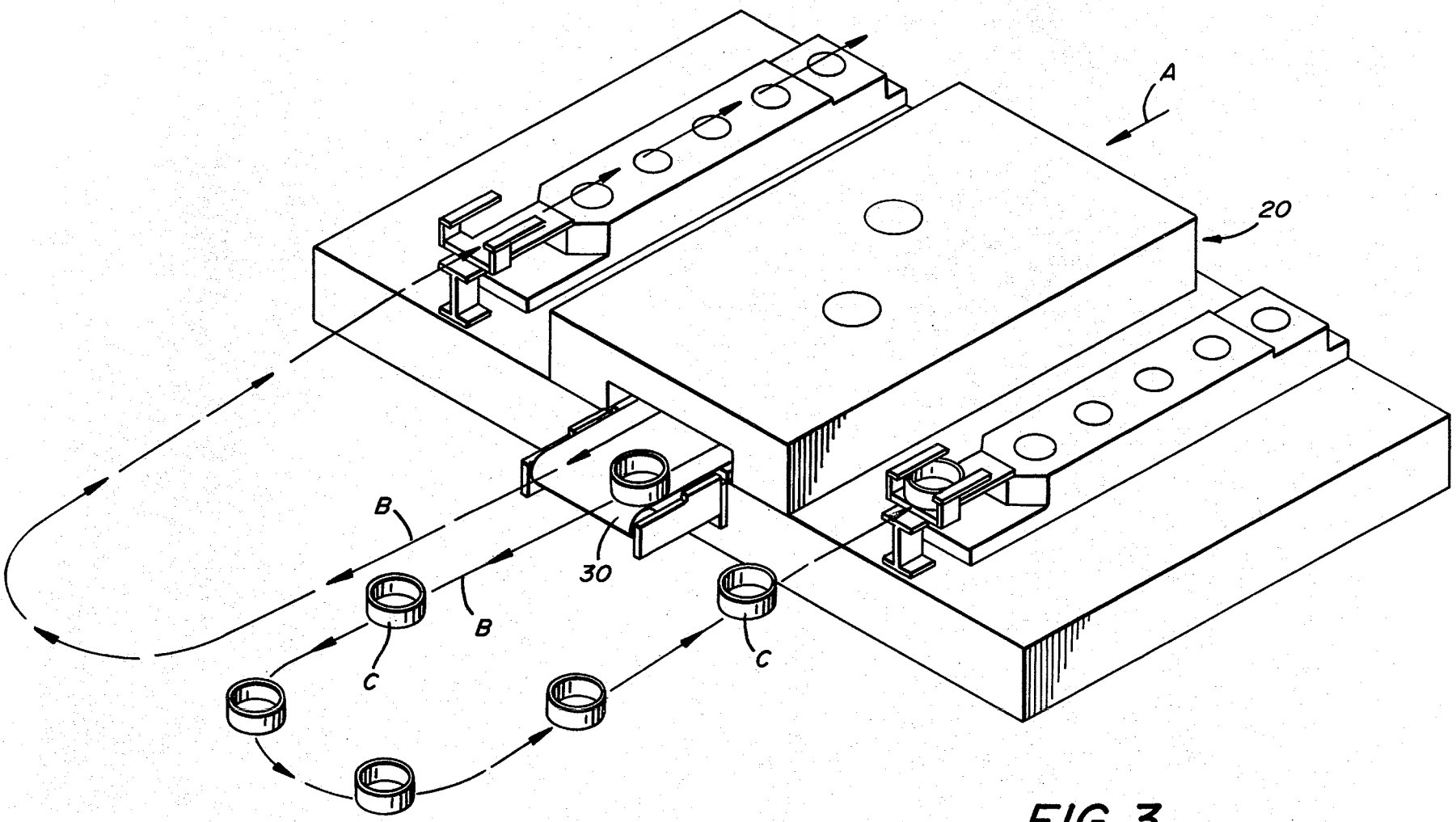
FIG. 3 is a perspective, schematic view of the press illustrating the method of operation of the system in the press area.
Figure 4:
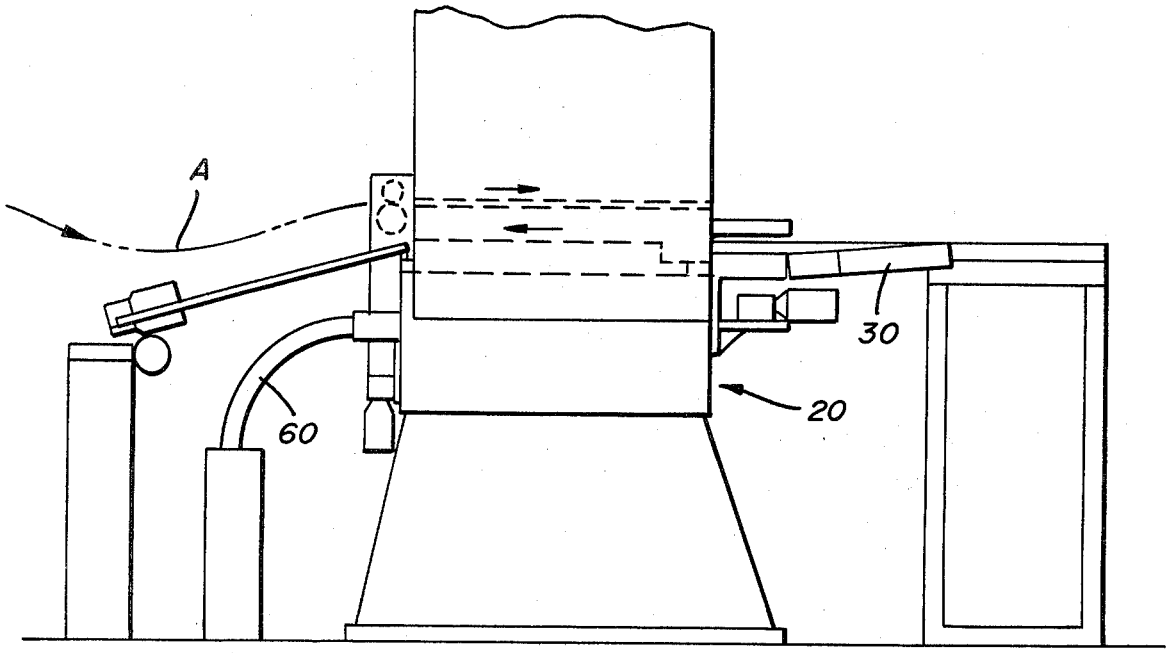
FIG. 4 is a side elevation of the press and its associated conveyors.

Referring then to FIGS. 1, 3, and 4, it will be noted that the cups thus formed will be passed through the blanking and cupping die and pass out of the press in dual lanes on the cup conveyors 30,30 which will, in turn, pass the cups back into the press 20 in the direction of the arrows B for further forming operations.

Reference is then again made to FIG. 2 wherein the remaining die sets of the press 20 are illustrated. Here it will be seen that the dies necessary for performing the remaining operations on the cups C are arranged on both sides of the cup die 20*a*. It will be noted that these include two parallel rows of stations along the opposed sides of the press capable of performing a number of operations.

These are identical and only the left hand one of FIG. 2 will be described in any detail.

Thus, as a cup C enters from one of the conveyors 30, station 21 mechanically orients the cup for further operations.

The cup is then mechanically transferred to station 22 which is the first draw station.

Once the first draw has been performed, the container thus partially formed is mechanically transferred to the sensing and idling station 23 where it is positively mechanically positioned and sensed. Essentially, this sensing is intended to insure that a container is present and is undamaged and suitable for further operations. A negative indication will cause the press operation to cease pending correction of the problem. The apparatus for such sensing is known in the art and is not illustrated herein in detail.

The drawn container is then passed to station 24, which is a redraw and bottom panel forming station.

Following this, mechanical transfer means are again actuated and the container is transferred to another idling and sensing station 25 for further checking and finally the container is moved to the station 26 which is capable of performing a third redraw and flange trim operation, such as shown in Bulso et al U.S. Pat. No. 4,022,089. It should be noted that the third redraw may not be required in all applications.

It also should be noted that employing the sensing and idling stations 23 and 25 insures precise positioning and material control. It also permits the material to cool between operations.

The containers will then exit the press 20 and be passed onto the can conveyor 50 with the scrap ring from the trimming operation passing onto the scrap conveyor 60 and finally into the scrap ring box 61.

The cans are moved along the conveyor 50 to an elevator 70 and onto a beader 75. Depending upon the particular type of container and its end use, this station is optional.

Either directly from the elevator or from the beader 75, the cans pass on then to an elevator 80 and finally to a tester and palletizer 90.

It will be appreciated that the mechanical apparatus for performing the method of the invention has not been illustrated in great detail at this point. The reason is that most of the hardware is readily available and known to one skilled in the art.

What has not heretofore, however, been apparent to those skilled in the art is that this hardware can be assembled into a system as described in this invention in which a "mini-line" can be produced which permits substantial volumes of containers to be produced without the expense of the conventional line employing a multiplicity of machines. This is a saving both in machine expense and also in the space required to produce substantial numbers of containers. It is believed that it is unique to assemble the various apparatus in the fashion set forth herein and it is also believed to be unique to take a cup out of a single press and put it back in to be redrawn.

This accomplishes a very efficient use of the press and of the energy required to drive the press, without any sacrifice in quality. There is also no sacrifice in quality in the control of the coating and metal integrity because what, in effect, is happening is that the conventional, gradual forming process of cupping, first redraw, second redraw, etc., is still being carried out although in a single press and in a much more compact system than has heretofore been known.

The particular arrangement of the draw-redraw stations on both sides of the blanking and cupping die also insures symmetrical press loading.

While a full and complete description of the invention has been set forth in accordance with the dictates of the Patent Statues, it should be understood that modifications can be resorted to without departing from the spirit hereof or the scope of the appended claims.

Thus, while certain specific forming operations such as draw, first redraw, second redraw, etc., have been described, it will be understood that these can be varied depending upon the requirements of the specific container being formed.

What is claimed is:

1. A method of forming container bodies from flat stock material in a reciprocating press, comprising the steps of:

(A) passing the stock into the press and blanking and cupping at least two cups in a central work area on each press cycle;

(B) forcing the cups through the die and transferring the cups out of the press along two divergent paths;

(C) directing the cups from said divergent paths to two parallel paths and returning the cups to the press to work areas on each side of the central work area;

(D) finish forming the cups into container bodies within the press; and (E) again transferring the containers out of the press.

2. The method of claim 1 wherein said finish forming of the cups is accomplished on opposite sides of the work area for blanking and cupping.

3. The method of claim 1 wherein said finish forming of cups into container bodies includes the steps of (A) drawing;

(B) redrawing; and (C) trimming.

4. The method of claim 3 wherein said finish forming of the cups into container bodies includes the step of positioning, cooling, and sensing between steps A and B and steps B and C.

5. Integrated apparatus for forming container bodies from flat stock material in a reciprocating press, comprising:

(A) a blanking and cupping station centrally disposed within the press;

(B) means for feeding the stock material into said blanking and cupping station;

(C) means for transferring the cups formed in the blanking and cupping station through their forming dies and into two divergent paths leading out of the press;

(D) a series of finish forming stations within the press and disposed on opposite sides of said centrally disposed blanking and cupping station; and (E) means for directing the cups from said divergent paths to two parallel paths and transferring the cups back into the same press and into said finish forming stations.

6. The apparatus of claim 5 wherein said finish forming stations include (A) draw dies;

(B) redraw dies; and (C) trim dies.

7. The apparatus of claim 6 wherein said finish forming stations include positioning and sensing stations interposed between said draw dies and redraw dies and between said redraw dies and trim dies.

8. Integrated apparatus for forming container bodies from flat stock material in a reciprocating press, comprising:

(A) a centrally disposed blanking and cupping station for blanking and cupping at least two cups on each press cycle;

(B) means for feeding the flat stock material into said blanking and cupping station;

(C) conveyor means disposed beneath said blanking and cupping station for receiving said cups;

(D) a parallel identical series of finish forming stations within the press, disposed on opposite sides of said blanking and cupping station;

(E) said conveyor means extending from beneath said blanking and cupping station out of and back into the press to each of said parallel series of finish forming stations (1) whereby said cups may be transferred back into the press for finish forming; and (F) means for transferring the finish formed containers from the press.

* * * * *